US009751101B2

(12) United States Patent
Tullney et al.

(10) Patent No.: US 9,751,101 B2
(45) Date of Patent: Sep. 5, 2017

(54) TRIGGER LOCKING DEVICE FOR A LIQUID APPLICATOR

(71) Applicant: Wagner Spray Tech Corporation, Plymouth, MN (US)

(72) Inventors: Heiko Tullney, Hamburg (DE); Matthias Mazur, Hamburg (DE); Joseph W. Kieffer, Chanhassen, MN (US)

(73) Assignee: Wagner Spray Tech Corporation, Plymouth, MN (US)

( * ) Notice: Subject to any disclaimer, the term of this patent is extended or adjusted under 35 U.S.C. 154(b) by 0 days.

(21) Appl. No.: 15/049,874

(22) Filed: Feb. 22, 2016

(65) Prior Publication Data

US 2016/0303599 A1 Oct. 20, 2016

Related U.S. Application Data

(60) Provisional application No. 62/149,178, filed on Apr. 17, 2015.

(51) Int. Cl.
*B05B 11/00* (2006.01)
*B05B 12/00* (2006.01)

(52) U.S. Cl.
CPC ..... *B05B 11/0027* (2013.01); *B05B 12/002* (2013.01)

(58) Field of Classification Search
CPC ..... B05B 11/0027; B05B 12/002
See application file for complete search history.

(56) References Cited

U.S. PATENT DOCUMENTS 4,105,164 A * 8/1978 Lau ..... B05B 7/12 239/526
5,176,327 A * 1/1993 Petersen ..... B05B 1/302 239/525
7,516,910 B1 * 4/2009 DeWall ..... B05B 9/01 239/525
2005/0178857 A1 * 8/2005 Roman ..... B05B 12/002 239/526
2009/0308892 A1 * 12/2009 Clark ..... B05B 12/002 222/153.14
2014/0346257 A1 * 11/2014 Reetz, III ..... B05B 12/002 239/526
2016/0303599 A1 * 10/2016 Tullney ..... B05B 12/002

OTHER PUBLICATIONS

International Search Report and Opinion for PCT/US2016/018928, dated Jun. 13, 2016, Filed Feb. 22, 2016. 10 pages.

* cited by examiner

*Primary Examiner* — Frederick C Nicolas
*Assistant Examiner* — Bob Zadeh
(74) *Attorney, Agent, or Firm* — Kelly, Holt & Christenson, PLLC; Katherine M. Scholz

(57) ABSTRACT

A trigger locking system for a liquid applicator having a trigger with an opening is provided. The trigger locking system comprises trigger locking device configured to extend through the opening. The trigger locking device is configured to move, when actuated, between a defined locked position and a defined unlocked position. While the system is in a locked position, the trigger is nonactuable. While the system is in an unlocked position, the trigger is actuable such that, when actuated, a liquid is released from the liquid applicator.

15 Claims, 12 Drawing Sheets

TRIGGER LOCKING DEVICE FOR A LIQUID APPLICATOR

CROSS-REFERENCE TO RELATED APPLICATIONS

The present application is based on and claims the benefit of U.S. Provisional Patent Application Ser. No. 62/149,178, filed Apr. 17, 2015, the contents of which are hereby incorporated by reference in its entirety.

BACKGROUND

Many users of liquid applicators, for example paint applicators, include a spray gun with a trigger. Triggers on paint applicators are often pressure actuated, for example, a user's hand or fingers can apply force to a trigger and, as a result of the applied force, paint, or another exemplary liquid, flows from an outlet of the liquid applicator. However, when a user releases pressure on the trigger, the outgoing flow ceases. For at least some paint applicators, the applied pressure corresponds to a volumetric flow rate of liquid exiting the applicator.

SUMMARY

A trigger locking system for a liquid applicator having a trigger with an opening is provided. The trigger locking system comprises a trigger locking device configured to extend through the opening. The trigger locking device is configured to move, when actuated, between a defined locked position and a defined unlocked position. While the system is in a locked position, the trigger is nonactuable. While the system is in an unlocked position, the trigger is actuable such that, when actuated, a liquid is released from the liquid applicator.

DETAILED DESCRIPTION OF ILLUSTRATIVE EMBODIMENTS

One problem facing operators of paint applicators is accidental paint release, often from unintended pressure on a trigger of the paint applicator. This can create unexpected cleaning operations that take time and may require additional cleaning materials. It is desired for a paint applicator to have a trigger locking device that can allow for an operator to easily lock and unlock the trigger as desired. In one embodiment, unlocking the trigger allows paint flow from an outlet of the paint applicator. In one embodiment, locking the trigger ensures that no unwanted paint is released or wasted.

It is desired for a paint gun with a trigger to easily accommodate a user's hand over an extended period of time without causing injury, discomfort or fatigue. However, it is also important that the applicator be easily disassembled and reassembled, for example in order to accommodate cleaning and replacement.

While aspects of the present disclosure describe a paint applicator, it is to be understood that at least some embodiments described herein may apply to other fluid applicators dispensing, for example, aqueous solutions, oil-based solutions, solutions with texture components, varnish, etc. However, for the sake of illustration, the example of a liquid applicator configured to apply paint to a surface will be described in further detail. A paint applicator with a trigger locking device may prevent a user from inadvertently actuating a trigger and releasing paint prematurely.

Figure 1A:
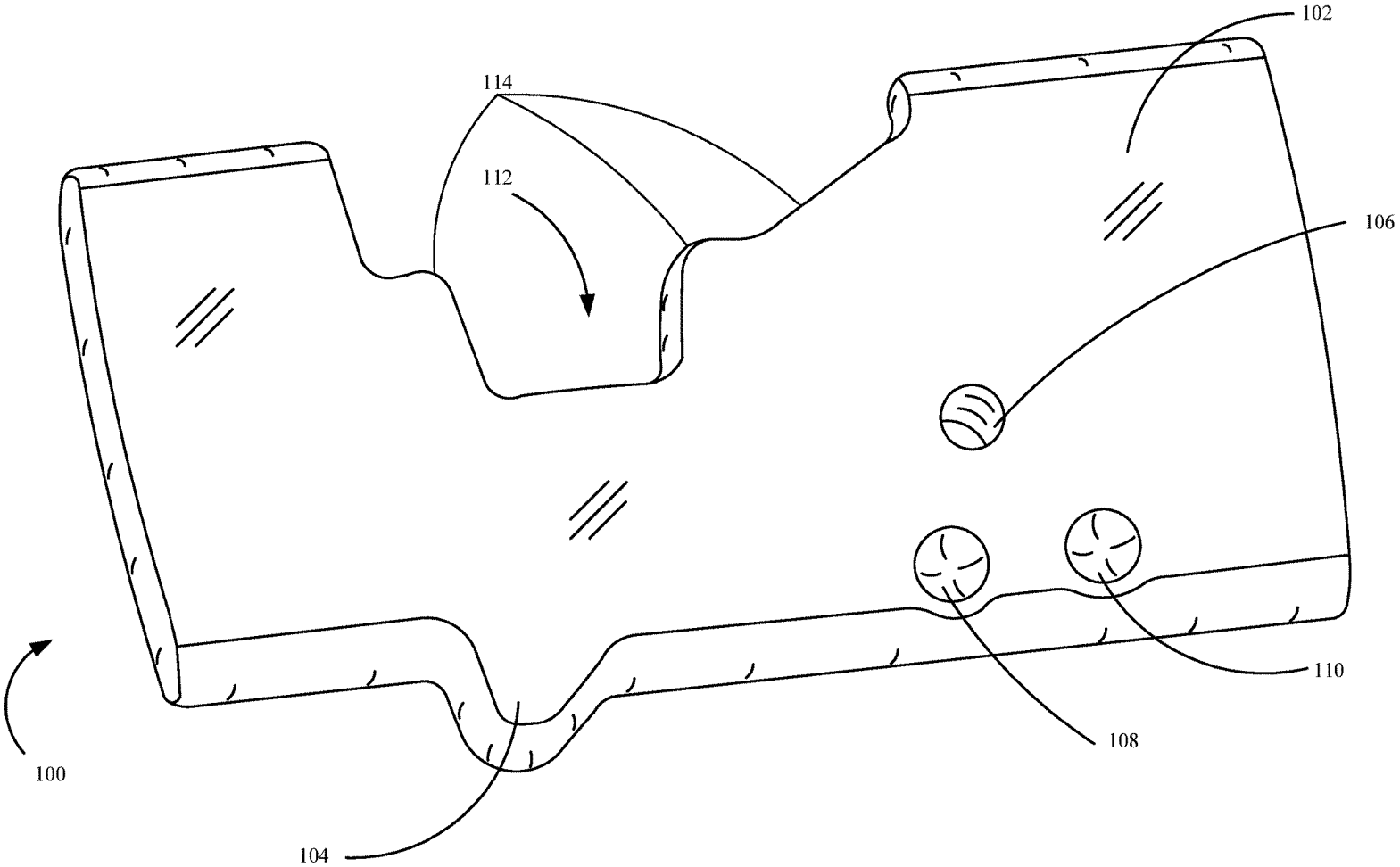
FIGS. 1A and 1B illustrate front and back views of a trigger locking device in accordance with one embodiment of the present invention.
Figure 1B:
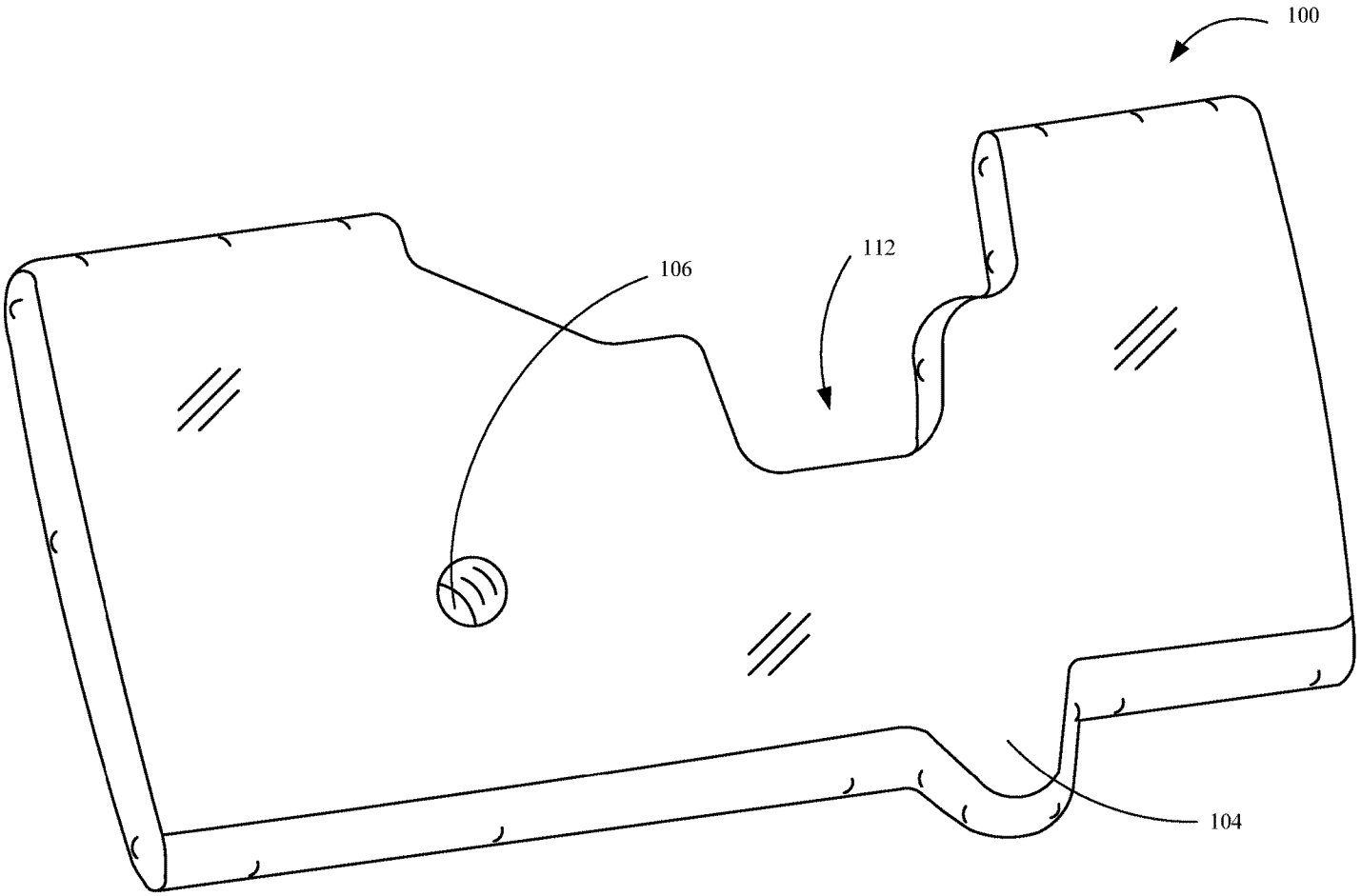

FIGS. 1A and 1B illustrate front and back views of a trigger locking device in accordance with an embodiment of the present invention. FIG. 1A illustrates a frontal view of a trigger locking device 100. Trigger locking device 100 comprises a latch 102, a restricting component 104, an applicator receiving portion 112 configured to position device 100 within a paint applicator, and a fixing mechanism 106. In one embodiment, fixing mechanism 106 is configured to maintain a position of trigger locking device 100 during a manufacturing process. Restricting component 104 can be configured to allow for trigger locking device 100 to be received within a paint applicator, and, when moved from a first position to a second position within the paint applicator, adjust between locking and unlocking configurations. In one embodiment, trigger locking device 100 can freely move between locking and unlocking configurations, but is otherwise restricted such that it is inhibited from, for example, falling out of a paint applicator during use.

In one embodiment, trigger locking device 100 also comprises a first indent 108, which, when engaged by a locking mechanism of a paint applicator, corresponds to an unlocked position of a trigger, and a second indent 110, which, when engaged by the locking mechanism, comprises a locked position of a trigger of a paint applicator. In one embodiment, indents 108 and 110 extend substantially, but not completely, through a width of locking device 100, as illustrated in FIG. 1A and FIG. 1B. However, in another embodiment, indents 108 and 110 substantially extend through a width of locking device 100. In another embodiment, indents 108 and 110 extend completely through a width of the locking device 100, such that in a locked configuration a locking mechanism extends through an entire width of locking device 100.

According to at least one embodiment, receiving component 112 comprises one or more restricting features 114 configured to engage a paint applicator. Restricting features 114, in one embodiment, are configured to accommodate internal components of a paint applicator as well as inhibit trigger locking device 100 from sliding too far in one direction within a paint applicator. For example, restricting features 114 may prevent a user wishing to slide locking device 100 from the unlocked position to a locked position, from accidentally removing locking device 100 from the applicator, in one embodiment.

Figure 5A:
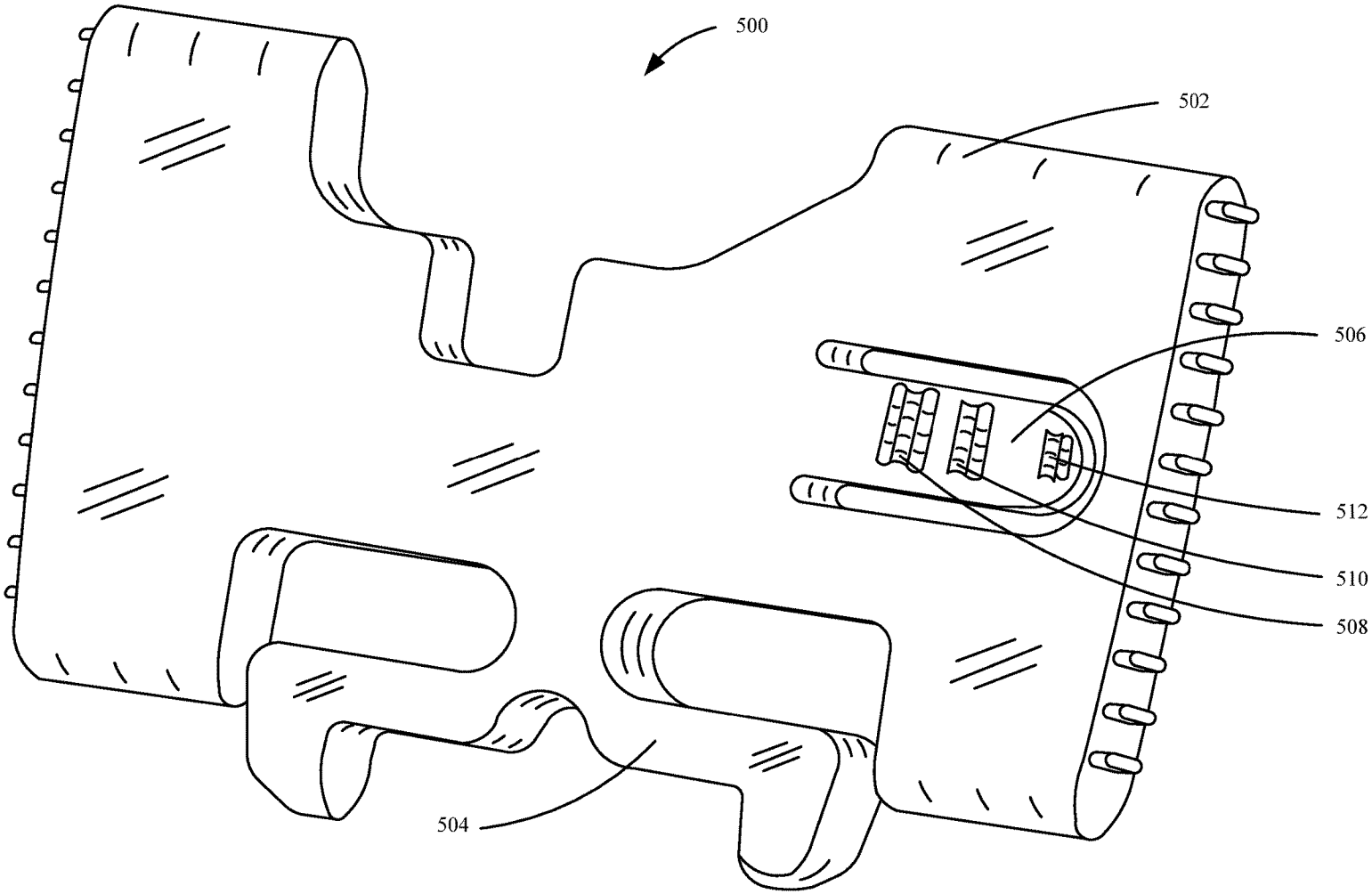
FIGS. 5A-5D illustrate an alternative embodiment of a trigger locking device and paint applicator in accordance with one embodiment of the present invention.
Figure 5B:
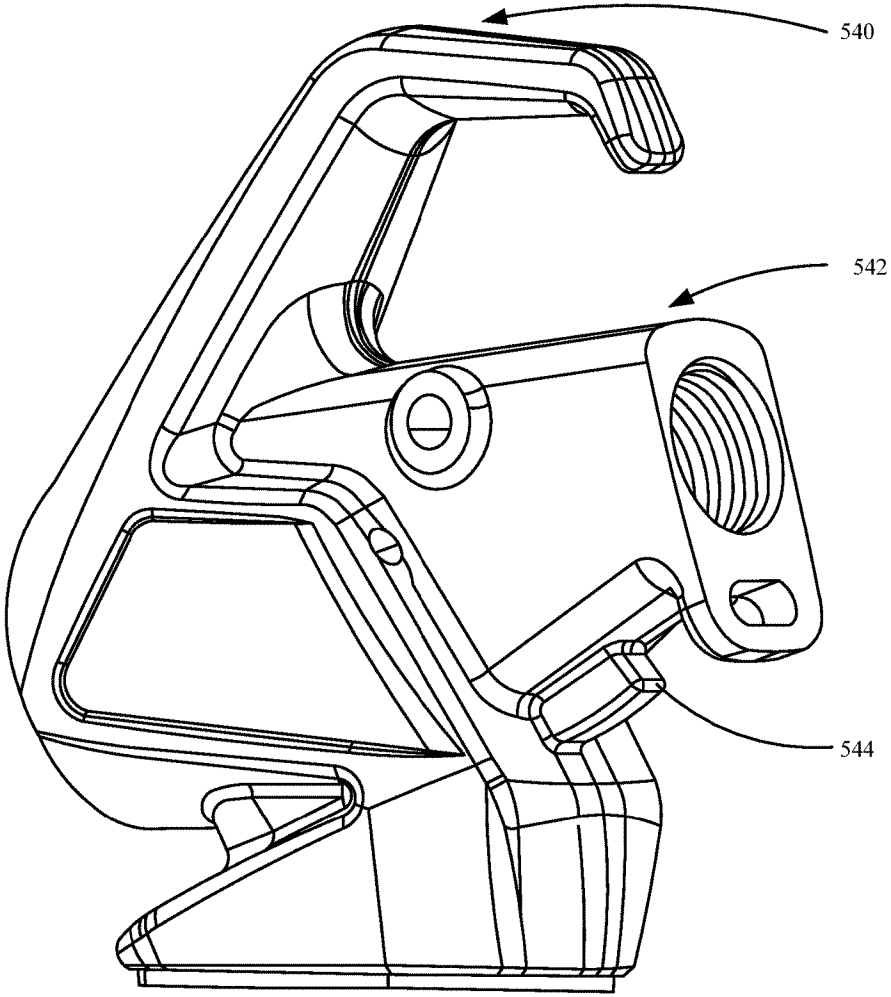
Figure 5C:
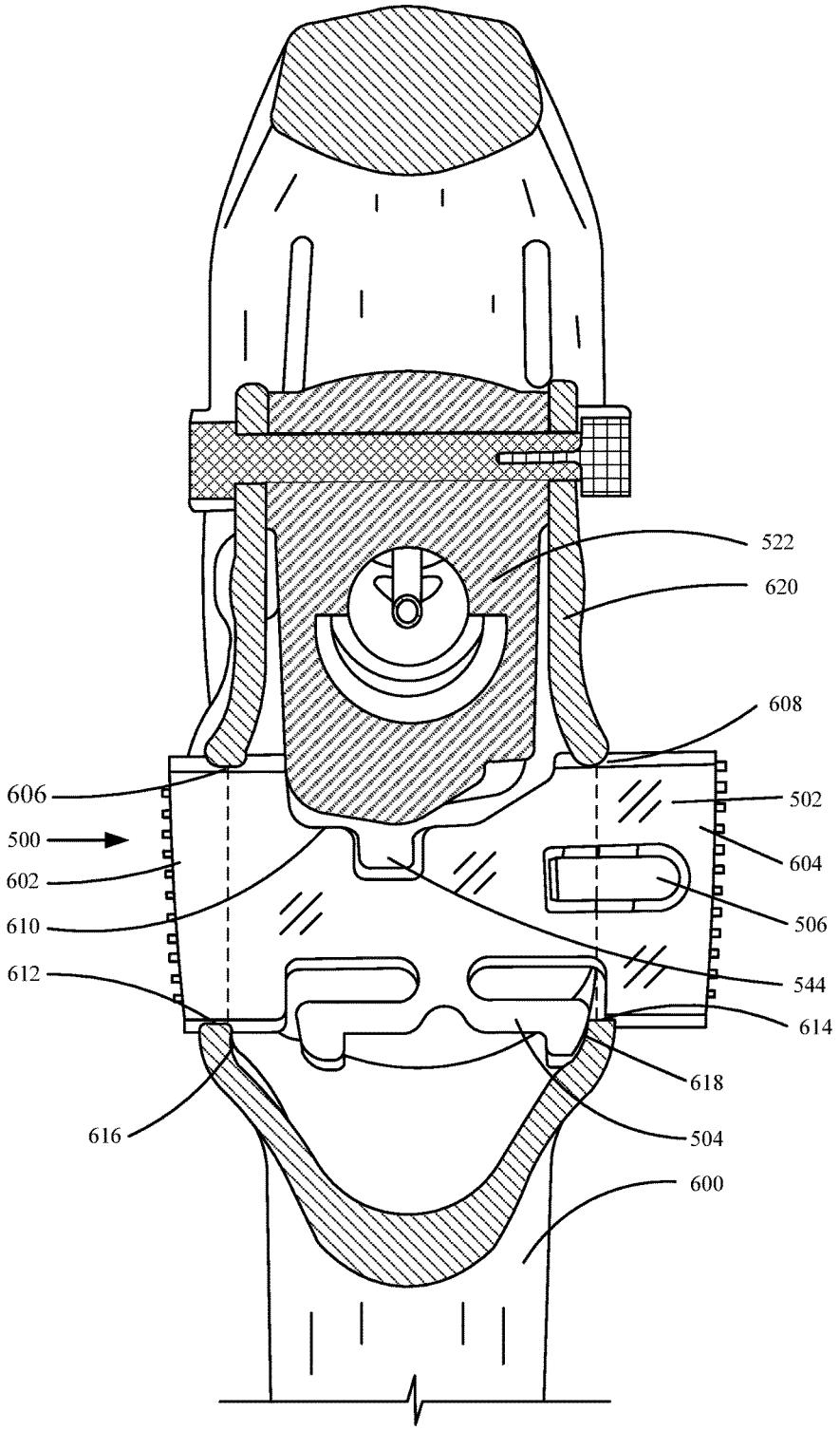
Figure 5D:
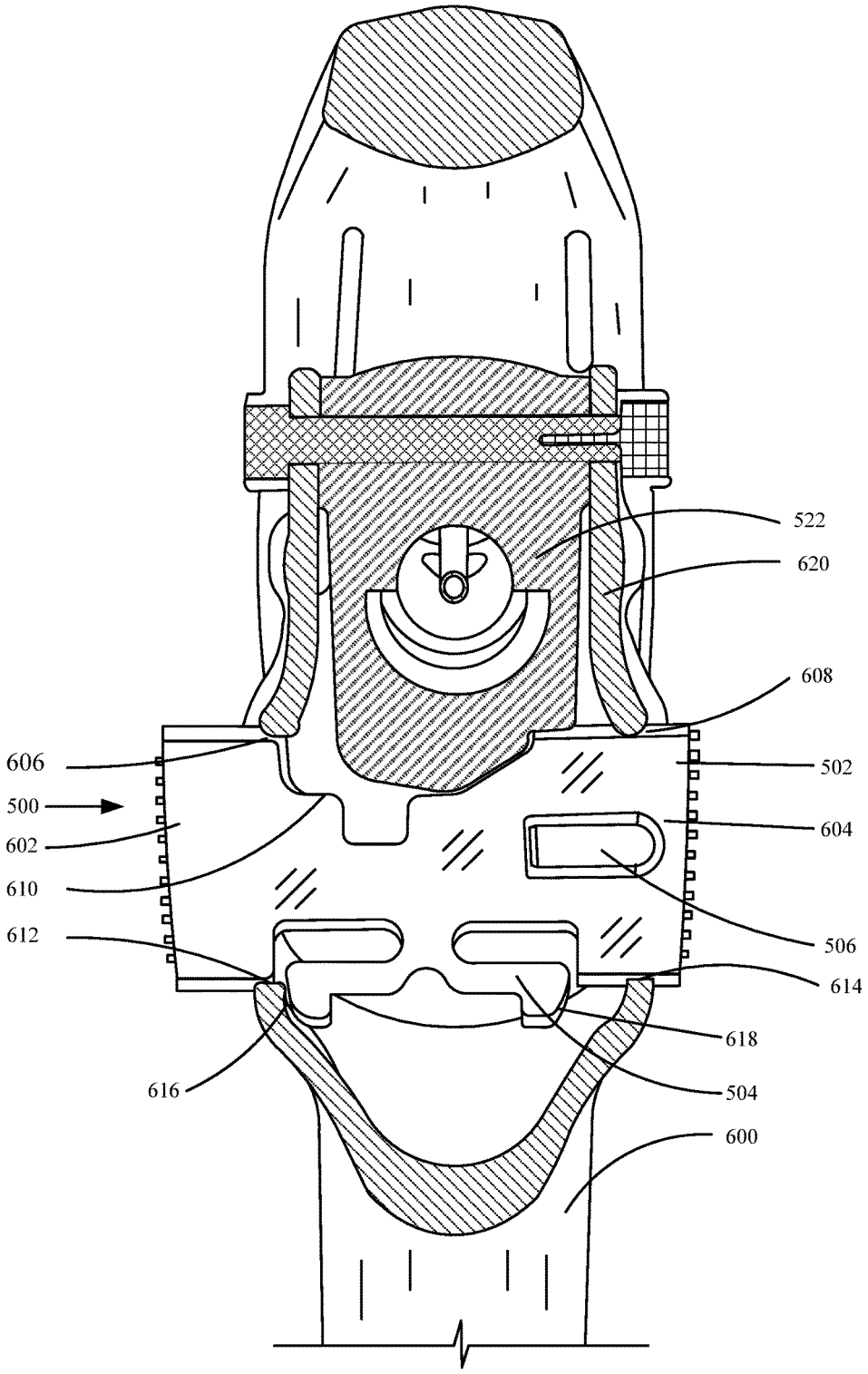

Movement of an exemplary trigger locking device is illustrated in the transition between FIG. 5C and FIG. 5D, which illustrate locked and unlocked positions, respectively, of a trigger locking device within a paint applicator. In one embodiment, when trigger locking device 100 enters a locked position, receiving component 112 reaches a trigger side wall. If the user tried to slide locking device 100 past the locked position, receiving component 112 pushes up against a side wall of a trigger, stopping locking device 100 from sliding past the locked position. Similarly, if the user wishes to slide locking device 100 from the locked position back to the unlocked position, receiving component 112 will reach the other trigger side wall. If the user tries to slide the latch past the unlocked position, receiving component 112 is pushed up against the other side wall, stopping locking device 100 from sliding past the unlocked position.

FIG. 1B illustrates a rear view of a trigger locking device 100, in one embodiment. As illustrated in FIG. 1A, indents 108 and 110 may be at least partially spherical in shape, such that they are configured to receive a sphere-like locking mechanism. However, indents 108 and 110 may comprise any other appropriate shape, for example square or cylindrical, such that they are configured to receive a correspondingly-shaped locking mechanism. Additionally, in one embodiment, fixing mechanism 106 comprises an aperture extending through a width of locking device 100. Fixing mechanism 106 may comprise a drilled hole. In another embodiment, fixing mechanism 106 comprises an indent drilled partially into, but not completely through, locking mechanism 100.

Figure 2:
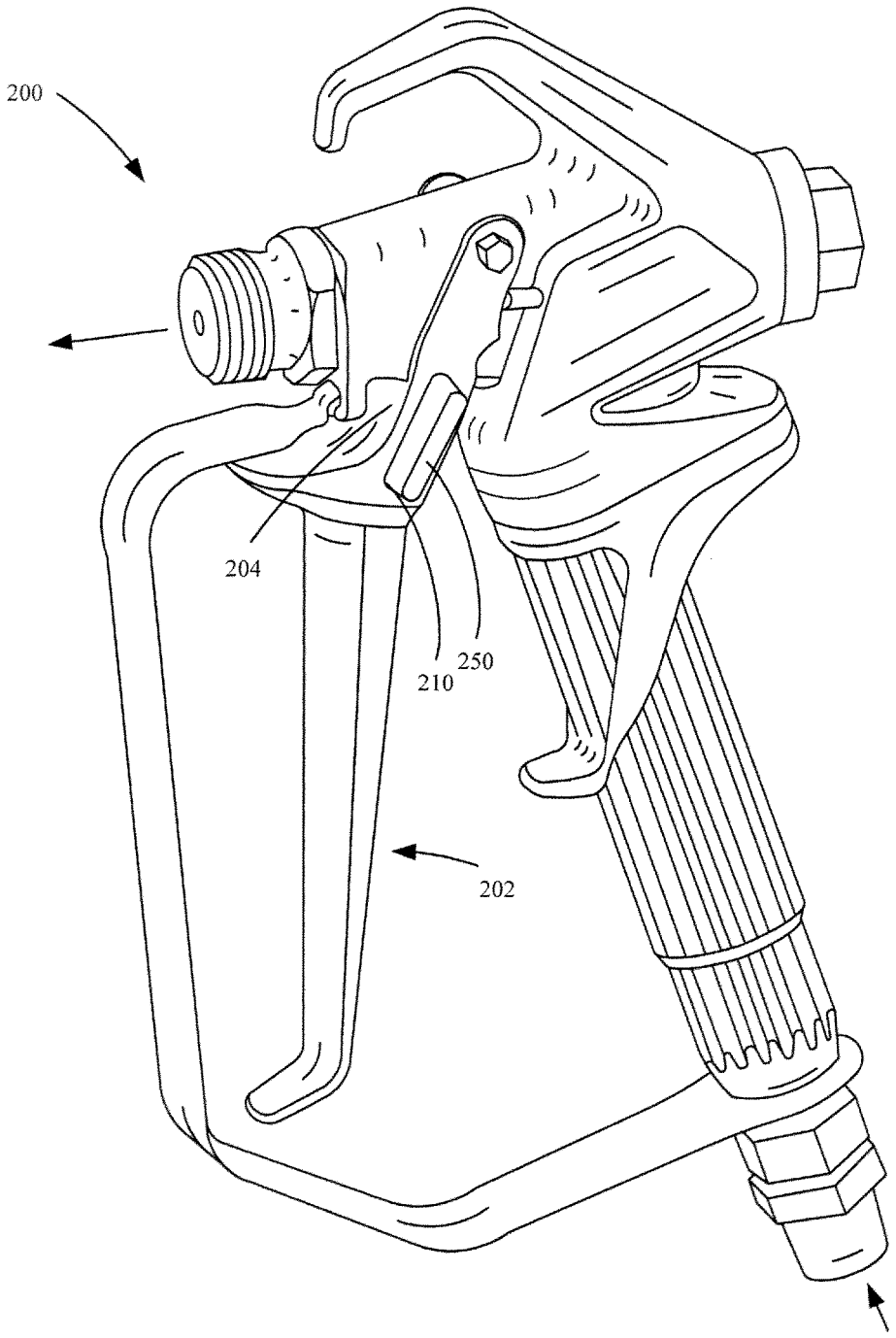
FIG. 2 illustrates a perspective view of a paint applicator in accordance with one embodiment of the present invention.

FIG. 2 illustrates a perspective view of a paint applicator in accordance with one embodiment of the present application. Paint applicator 200 comprises a trigger locking device 250. In one embodiment, trigger locking device 250 is substantially similar to locking device 100, illustrated and described above with respect to FIGS. 1A and 1B. In the example shown in FIG. 2, trigger 202 of paint applicator 200 is defined in part by a support wall 204, which comprises a die cast wall. Die cast wall 204 provides additional strength, and reinforcement, to trigger locking device 250, while in a locked position. In one embodiment, die cast wall 204 facilitates an even distribution of applied force on trigger locking device 250. This may provide for increased durability.

In one embodiment, locking device 250 is configured to slide between a locked and unlocked position within an exemplary paint applicator. In a locked position, trigger locking device 250 is configure to prevent actuation of the trigger. For example, locking device 250 can have a first end and a second end. The first end of locking device 250 may, in one embodiment, extend through a first opening 210 of trigger 202 and the second end of locking device 250 may extend through a second opening (not shown) on the opposite side of trigger 202. Moreover, between the first and second ends may be one or more restricting components (for example restricting component 104 illustrated in FIGS. 1A and 1B) in locking device 250. In the unlocked position, a restricting component substantially borders (is adjacent to) an element of a paint applicator barrel such that, when trigger 202 is pulled, a first rim of first opening 210 will push against the first end of locking device 250, and a second rim of the second opening will push against the second end. As a result, trigger locking device 250 will move with trigger 202, and trigger locking device 250 will clear the barrel, enabling trigger 202 to move and actuate paint applicator 200.

Figure 3A:
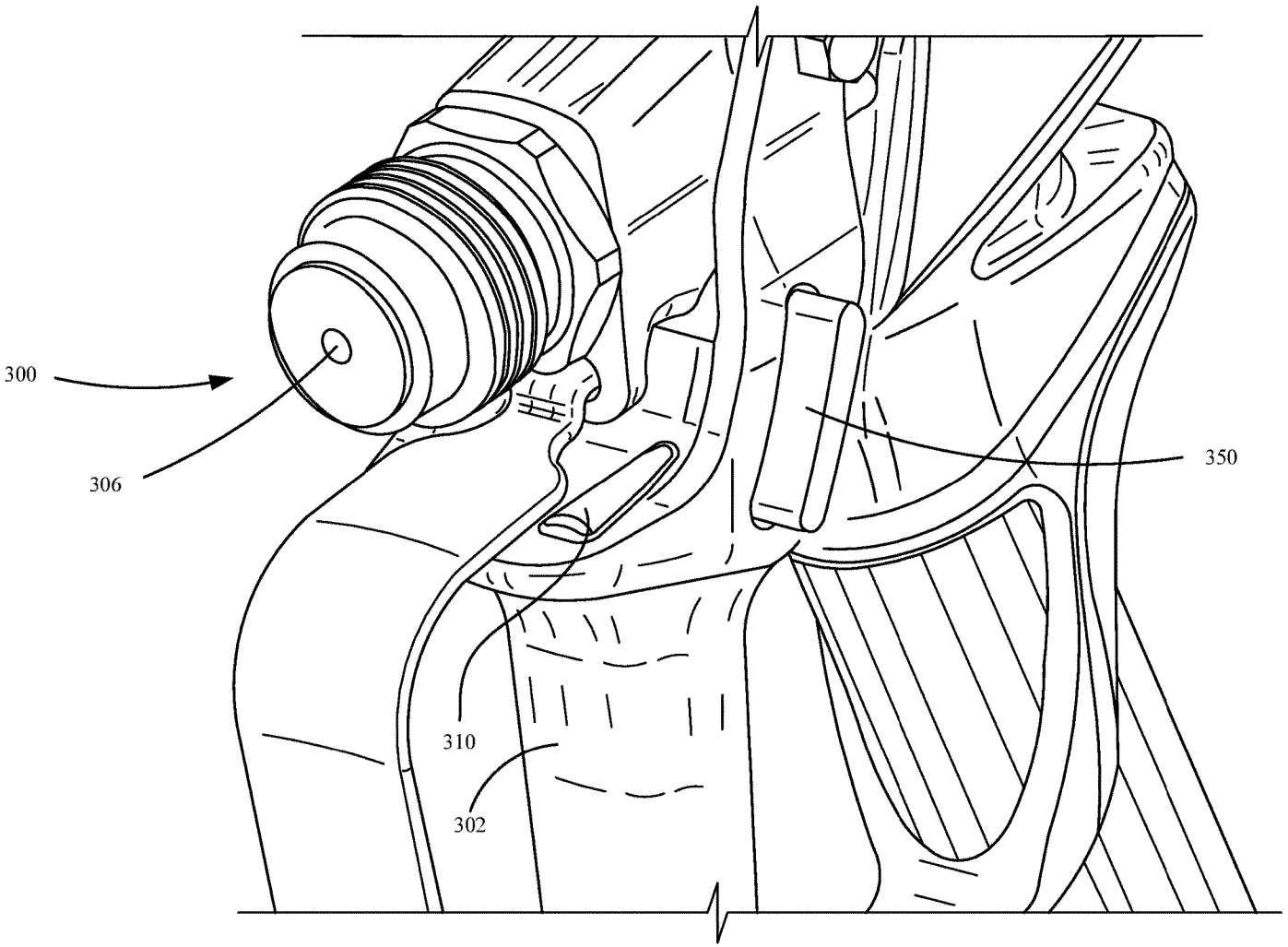
FIGS. 3A-3D illustrate different perspective views of a trigger locking device in a paint applicator in accordance with one embodiment of the present invention.

FIGS. 3A-3D illustrate different perspective views of a trigger locking device in a paint applicator in accordance with one embodiment of the present invention. FIG. 3A illustrates a partial perspective view of a portion of a paint applicator 300 incorporating a trigger locking device 350. In one embodiment, trigger locking device 350 comprises a similar structure to trigger locking device 100, described above. In one embodiment, such as that illustrated in FIGS. 3A-3D, trigger 302 is in a locking position, such that a locking mechanism, for example housed within lock housing 310, engages a first indentation 308 of trigger locking device 350. In one embodiment, when trigger 302 is actuated, paint, or another exemplary liquid is released through paint outlet 306.

Figure 3B:
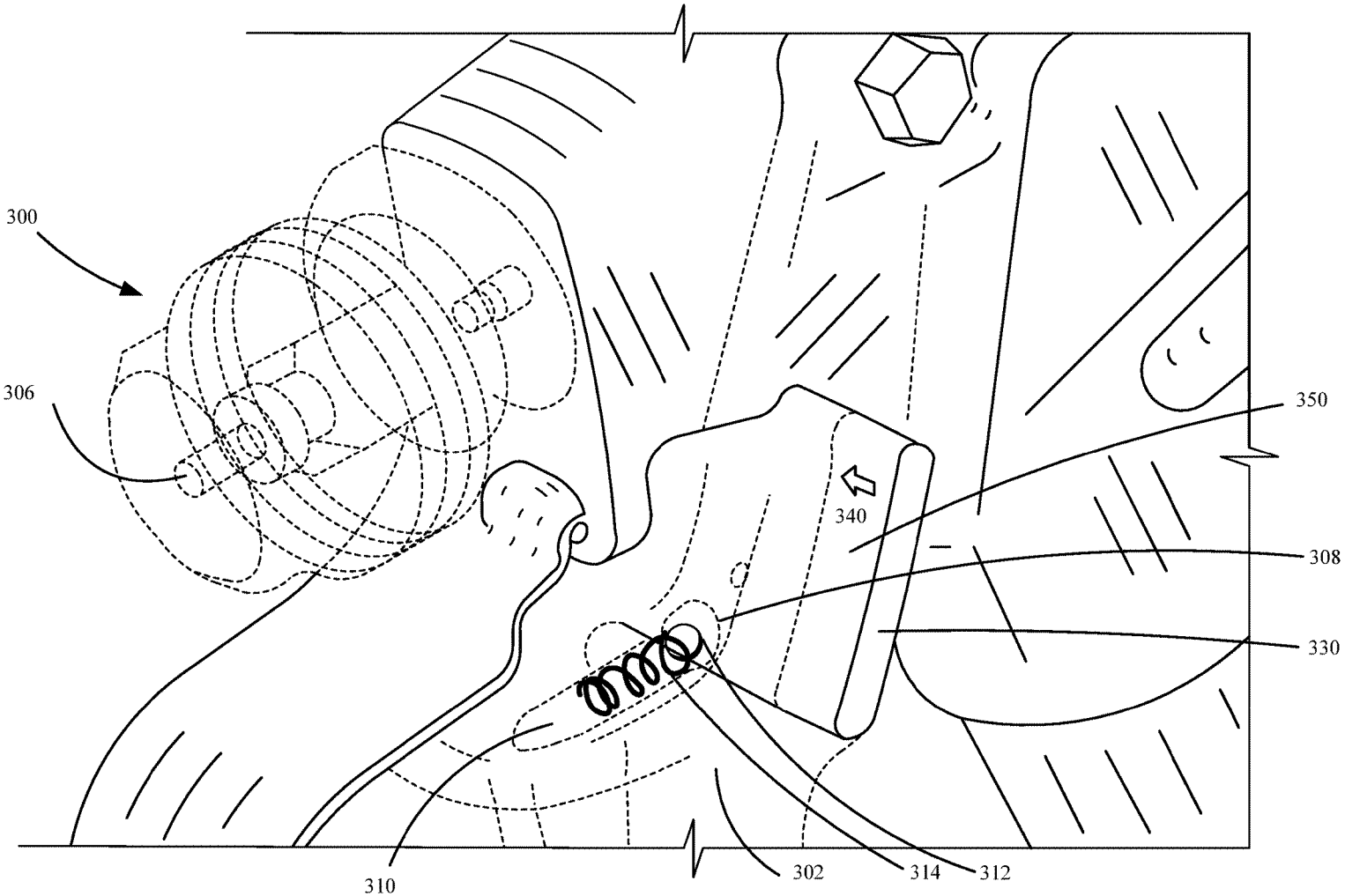

FIG. 3B illustrates an internal view of paint applicator 300, illustrating the function of a locking mechanism within locking mechanism housing 310. In one embodiment, such as that illustrated in FIGS. 3B and 3C, the locking mechanism comprises a spring 314 and ball 312 combination. Spring 314 is configured to provide a biasing force against ball 312, such that ball 312 maintains contact with trigger locking device 350, for example with indentation 308 or 310.

In one embodiment, the tension on spring 314 is such that an operator of the paint applicator can move trigger locking device 350, for example in the direction indicated by arrow 340, by applying pressure on an edge of device 350, such that the applied force moves trigger locking device 350 between an unlocked and locked position. In one embodiment, a locked position comprises ball 312, urged by spring 314, connecting with indentation 308. When an operator is ready to use paint applicator 300, the operator applies a force to edge 330 of device 350, forcing spring 314 to contract, and, as device 350 moves along an axis defined by arrow 340, re-expand and forces ball 312 into contact with indent 310. In another embodiment, operator does not contact trigger locking device 350 directly, but pushes a button that actuates movement of trigger locking device 350 in the direction indicated by arrow 340. In one embodiment, for example after a paint job is completed, to replace trigger locking device 350 in a locked position, the operator pushes on an opposing edge of trigger locking device 350 such that device 350 moves in a direction opposite to that indicated by arrow 340.

Figure 3C:
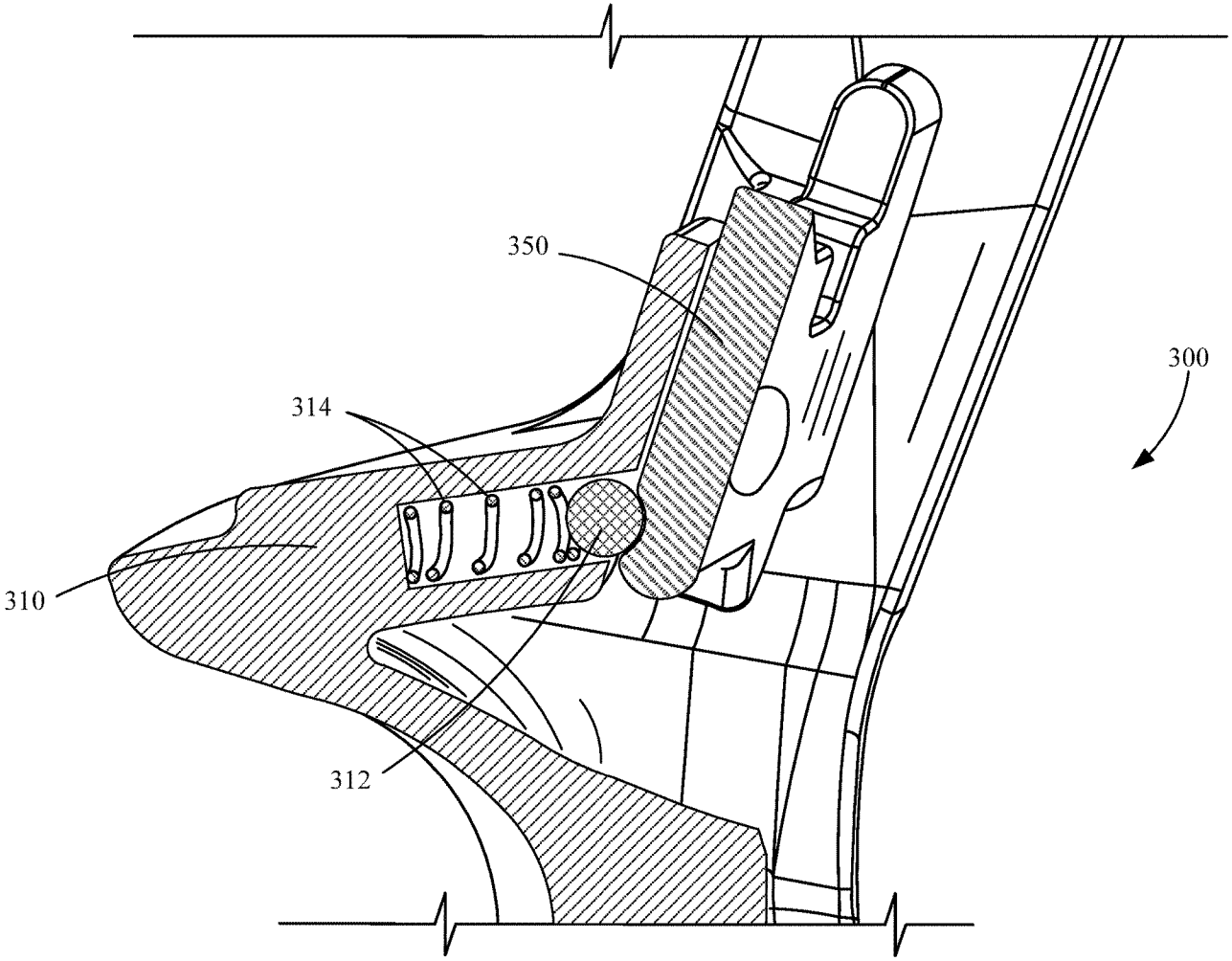

FIG. 3C illustrates an internal cutaway view of trigger locking device 350. In either of a locked or an unlocked position, an indent, for example either of indent 308 or 310, is engaged by ball 312, urged forward by spring 314. Ball 312 and spring 314 are housed within locking mechanism housing 310. Locking mechanism housing 310 may keep ball 312 and spring 314 protected from contamination by a liquid moving through liquid applicator 300.

Figure 3D:
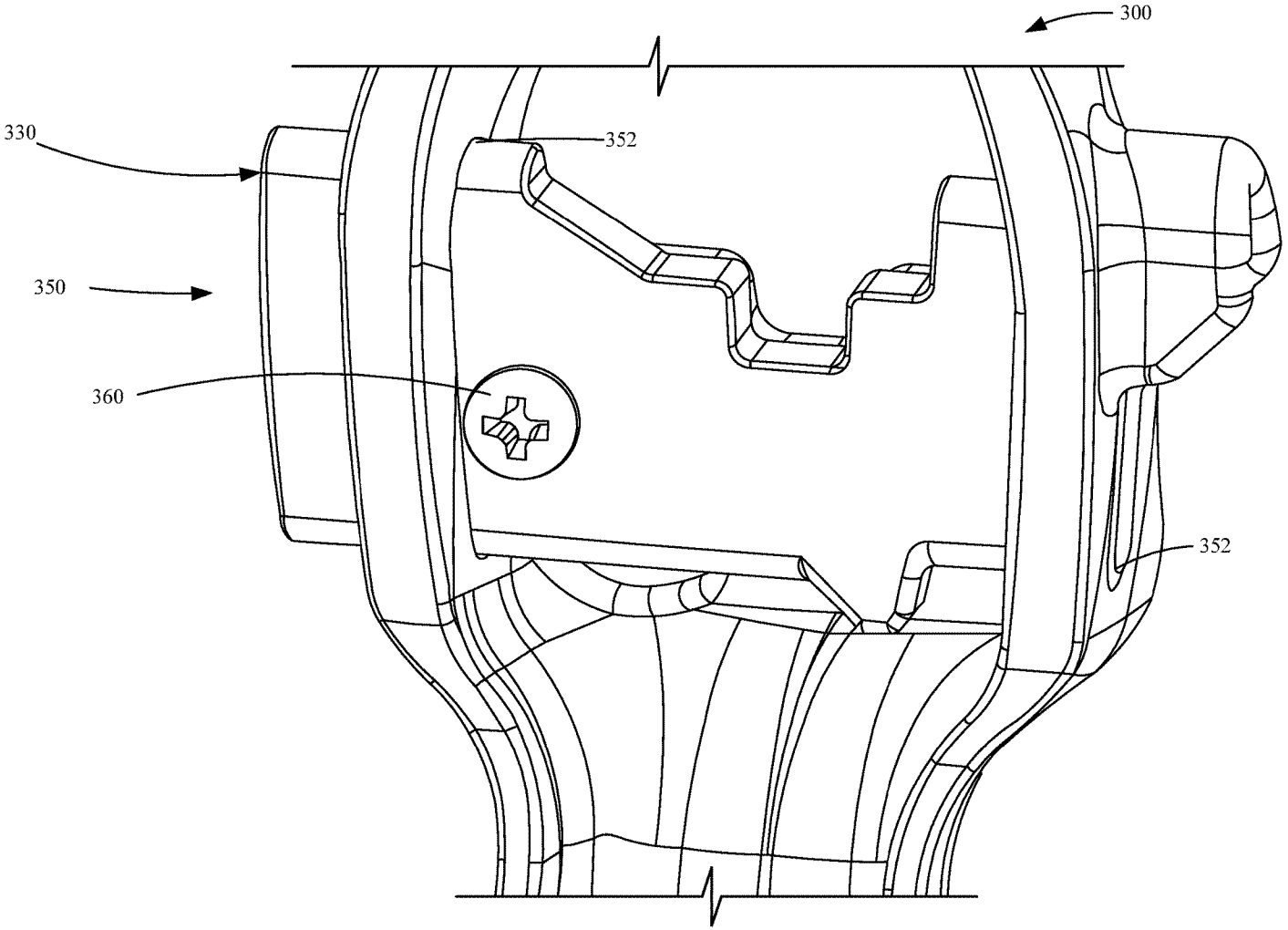

FIG. 3D illustrates a substantially rear internal view of lock assembly 350. During a manufacturing process, in one embodiment, device 350 may be locked into place, for example using a lock capture mechanism 360. During assembly of an exemplary paint applicator, it may be desired for trigger locking device 350 to remain substantially immobile. In one embodiment, a lock capture mechanism 360 is configured to engage a rear face of trigger locking device 350, such that it fits within a fixing mechanism, for example fixing mechanism 106, as shown and described with regard to FIG. 1B.

In one embodiment, trigger locking device 350 is defined, at least in part, as having a length wider than that of a paint applicator, such that trigger locking device 350 extends, at least on one side, beyond an edge of paint applicator 300 through a trigger lock receiving slot 352. In one embodiment, trigger locking device 350 is physically movable between a locked and unlocked position by an operator applying pressure to an edge 330 of trigger locking device 350 extending beyond an edge of the paint applicator such that trigger locking device 350 is urged through the trigger receiving slot 352. In either of a locked or unlocked position, trigger locking device 350 is flush with an outer edge of paint applicator 300. In one embodiment, trigger locking device 350 is configured to have a length such that a first edge of trigger locking device 350 is flush with a first outer edge of paint applicator 300 in a locked position, and, in an unlocked position, a second edge of trigger locking device 350 is flush with a second outer edge of paint applicator 300.

Figure 4:
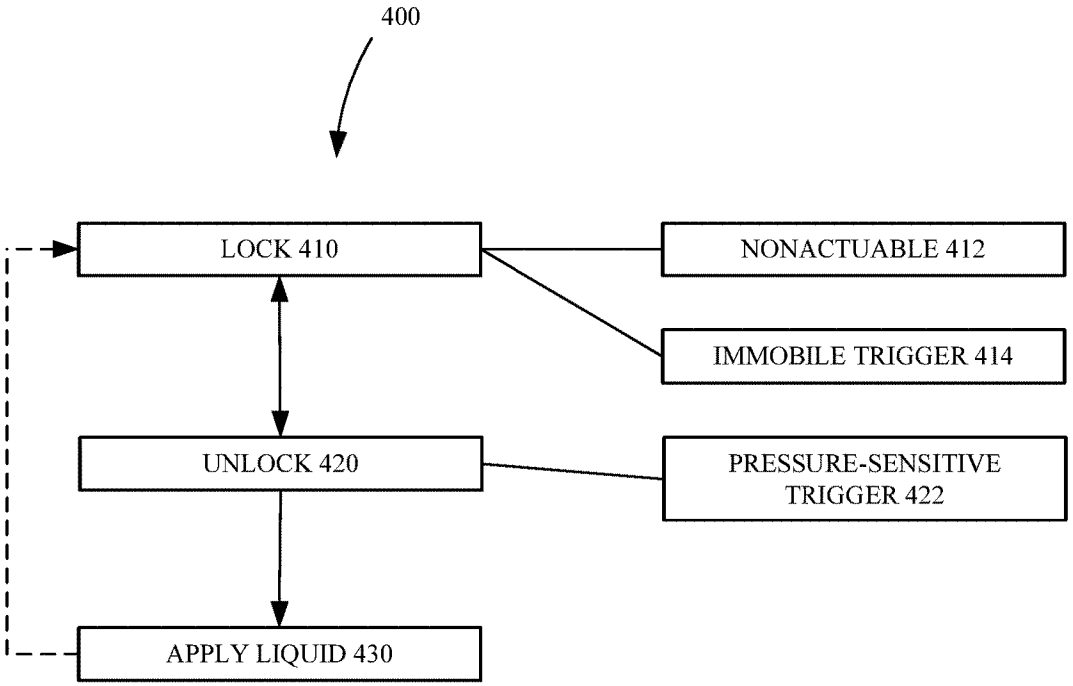
FIG. 4 illustrates an exemplary method of utilizing a paint applicator with trigger locking device in accordance with one embodiment of the present invention.

FIG. 4 illustrates an exemplary method for use of a paint applicator in accordance with one embodiment of the present invention. Method 400 may be utilized with other exemplary fluid applicators as appropriate, however, and is not limited to paint applicators.

In block 410, a trigger locking device is in a locked position. In one embodiment, while in the locked position, a trigger is non-actuable, as indicated in block 412. In at least one embodiment, in a locked position, the trigger is also immobile, as indicated in block 414, such that pressure applied by an operator to the trigger will not result in the trigger releasing paint, or moving substantially. However, in another embodiment, the trigger may still be movable, but pressure applied to the trigger will not result in paint flow from an outlet 306 of a paint applicator.

In block 420, a trigger is unlocked, and a paint applicator configured to apply fluid. In one embodiment, unlocking comprises moving a trigger locking device from a locked to an unlocked position, for example by actuating the trigger locking device such that a locking mechanism disengages from a locked position and engages with an unlocked position. In one embodiment, moving the trigger locking device comprises sliding it along an axis within a trigger slot. In one embodiment, once in an unlocked position, the trigger is actuated by applied pressure, for example by an operator, as indicated in block 422. In at least one embodiment, unlocking the trigger also comprises removing a fixing mechanism, for example, placed by a previous operator or placed during manufacturer.

In block 430, as desired, an operator applies a liquid through the liquid applicator, by actuating an application mechanism. In one embodiment, applying a liquid comprises an operator applying pressure on a trigger of a liquid applicator. An operator applies pressure, and removes applied pressure, to the trigger as desired during a job, such that a trigger locking device does not automatically reengage a locked position without actuation by the operator. In one embodiment, in order to relock the trigger of a paint applicator, an operator must move the trigger locking device from an unlocked position to a locked position. This may involve, for example, pressing on an edge of the trigger locking device such that the trigger locking device slides from an unlocked position back to a locked position. In another embodiment, upon a complete removal of applied pressure from the trigger, the locking device moves back from the unlocked position to a locked position.

FIGS. 5A-5D illustrate an alternative embodiment of a trigger locking device and paint applicator in accordance with one embodiment of the present invention. In one embodiment, trigger locking device 502 includes a locking device 502, a restricting component 504, and a snap 506. In one embodiment, snap 506 is configured with a first ridge 508, a second ridge 510, and a third ridge 512, as illustrated in FIG. 5A.

FIG. 5B depicts a perspective view of a section of a paint applicator 540 in accordance with one embodiment. In one embodiment, paint applicator 540 comprises a barrel 542 that includes a lock support stop 544.

FIGS. 5C and 5D depict frontal cutaway views of a trigger locking device 502, within a paint applicator 500, in accordance with one embodiment. Paint applicator 500, in one embodiment, comprises a trigger 600 as a paint flow actuation mechanism, as shown in full in FIG. 5D. As depicted in FIG. 5C, trigger locking device 502 is in an unlocked position, while in FIG. 5D, trigger locking device 502 is shown in a locked position.

In an unlocked position, in one embodiment, locking device 502 has a first end 602 and a second end 604. In one embodiment, first end 602 of locking device 502 extends through a first opening 606 of trigger 600, and second end 604 of locking device 502 extends through a second opening 608, located on an opposite side of trigger 600 from first opening 606. In one embodiment, between first end 602 and second end 604, is a notch 610. When locking device 502 is in an unlocked position, in one embodiment, notch 610 substantially borders barrel 522, such that, when trigger 600 is pulled, a first rim 612 of first opening 606 pushes against first end 602 of locking device 502, and a second rim 614 of second opening 308 pushes against second end 604. As a result, trigger locking device 502 moves with trigger 600, and trigger locking device 502 clears the barrel element 522, enabling trigger 600 to move and actuate flow of paint through paint applicator 500.

In one embodiment, trigger locking device 502 can be further configured to slide to a locked position, for example that illustrated in FIG. 5D. In a locked position, in one embodiment, trigger 600 is prevented from moving within, and allowing actuation of, paint applicator 500. In the locked position illustrated in FIG. 5D, notch 610 in locking device 502 is slid over, such that part of locking device 502 overlaps a lock support 544, as shown in FIG. 5C. When trigger 600 is actuated, first rim 612 pushes against first end 602 of locking device 502, and second rim 614 pushes against second end 604. However, because locking device 502 overlaps lock support stop 544, lock support stop 544 pushes trigger locking device 502 in the opposite direction as first rim 612 and second rim 614, and stops movement of trigger 600.

In one embodiment, restricting component 504 stops locking device 502 from being slid too far in one direction, such that it no longer extends through first opening 606 or second opening 608. For example, an operator wishing to slide trigger locking device 502 from the unlocked position to the locked position may do so, but trigger locking device 502 will move no further than either the locked position, in the first direction, or the unlocked position, in the second direction.

Restricting component 504, in one embodiment, is shaped similar to an upside down bicycle handlebar where it is connected to a middle of locking device 502, and does not extend fully through trigger 600, in one embodiment. However, other exemplary shapes of restricting component 504 are also envisioned. When trigger locking device 502 reaches the locked position, restricting component 504 has reached a first side wall 616 of trigger 600. If the user tries to slide trigger locking device 502 past the locked position, restricting component 504 is pushed up against first side wall 616, stopping trigger locking device 502 from sliding past the locked position. Similarly, if a user wants to slide trigger locking device 502 from the locked position back to the unlocked position, restricting component 504 will reach a second side wall 618 of trigger 600. If the operator tries to slide the trigger locking device 502 past the unlocked position, restricting component 504 pushes against second side wall 618, stopping trigger locking device 502 from sliding past the unlocked position.

In one embodiment, snap 506 is configured to inhibit movement of trigger locking device 502 between first opening 606 and second opening 608. For example, in the unlocked position, snap 506 can overlap a bracket 620 of trigger 600 such that bracket 620 is sandwiched between a first ridge 508 and a second ridge 510. Such a configuration may keep trigger locking device 502 from involuntarily sliding from side to side during operation, or storage, of paint applicator 500. If the user desires to move trigger locking device 502 into a locked position, the user can push second end 604 of locking device 502 through a second opening 608 and snap 506 can slide over bracket 620. When trigger locking device 502 has reached a locked position, in one embodiment, snap 506 covers bracket 620 such that bracket 620 is sandwiched between the second ridge 510 and third ridge 512, keeping trigger locking device 502 substantially immobile such that it cannot move from side to side.

In one embodiment, a trigger locking device comprises powdered metal. In another embodiment, the trigger locking device comprises a polymeric material, for example plastic. In one embodiment, the trigger locking device is injection-molded. However, in other embodiments, other appropriate materials and manufacturing methods are used to generate a trigger locking device.

The position of a trigger locking device in either of the locked and unlocked positions may vary according to various embodiments. For example, in one embodiment, the trigger locking device will be in the unlocked position when the first end and second end equally extend out of their respective trigger openings. In this embodiment, moving the trigger locking device to the locked position requires a user to move the trigger locking device to either the right or left side such that one end extends further out its respective trigger opening than the other end. In another embodiment, the trigger locking device will be in the unlocked position when the first end extends out its respective trigger opening further than the second end extends out its respective trigger opening. In this embodiment, the locking device is essentially further to the right or the left with respect to the trigger in an unlocked position, and to move the trigger locking device to the locked position, the user will have to push the latch to essentially the middle of the barrel, where the first and second ends extend out of their respective trigger openings equally.

Although the present invention has been described with reference to preferred embodiments, workers skilled in the art will recognize that changes may be made in form and detail without departing from the spirit and scope of the invention.

What is claimed is:

1. A trigger locking system for a liquid applicator having a trigger with an opening, the trigger locking system comprising:

a trigger locking device configured to extend through the opening, wherein the trigger locking device is configured to move, when actuated, between a locked position and an unlocked position;

wherein, in the locked position, the trigger is nonactuable;

wherein, in the unlocked position, the trigger is actuable such that, when actuated, a liquid is released from the liquid applicator; and wherein the trigger locking device is configured to receive a locking mechanism, wherein the locking mechanism is configured to engage a first position or a second position on the trigger locking device, wherein the first position comprises the trigger locking device in the locked position, and wherein the second position comprises the trigger locking device in the unlocked position, and wherein the first position and the second position each comprise an indentation.

2. The trigger locking system of claim 1, wherein the liquid comprises a paint.

3. The trigger locking system of claim 1, wherein, in the locked position, the trigger is substantially immovable.

4. The trigger locking system of claim 3, wherein the locked position further comprises the trigger locking device overlapping an element of the liquid applicator.

5. The trigger locking system of claim 1, and further comprising:

a restricting component configured to stop the trigger locking device from sliding out of the opening.

6. The trigger locking system of claim 1, wherein the locking mechanism comprise a ball and spring within a locking mechanism housing, wherein the ball is configured to engage the indentation.

7. The trigger locking system of claim 1, and further comprising:

a fixing mechanism configured to hold the trigger locking device substantially in a fixed position within the liquid applicator.

8. The trigger locking system of claim 1, wherein actuating the trigger locking device comprises an applied pressure to an edge of the trigger locking device.

9. An applicator configured to apply a fluid, comprising:

a fluid path extending from an inlet of the applicator to an outlet of the applicator;

a trigger configured to, when actuated, allow the fluid to flow through entirety full length of the fluid path;

a trigger locking device configured to move between a locked position and an unlocked position, wherein the locked position comprises the trigger locking device positioned such that the trigger locking device substantially inhibits actuation of the trigger; and a locking mechanism configured to maintain the trigger locking device in either the locked position or the unlocked position, and wherein the locking mechanism comprises a ball and spring configuration, wherein the spring is configured to provide a biasing force against the ball, such that the ball engages an indent of the trigger locking device.

10. The applicator of claim 9, wherein the trigger locking device is held in a fixed position by a fixing mechanism during manufacture.

11. The applicator of claim 9, and further comprising:

a locking housing configured to house the locking mechanism such that the locking mechanism is housed substantially within the applicator.

12. The applicator of claim 9, wherein moving the trigger locking device between the locked position and the unlocked position comprises application of sufficient pressure to an edge of the trigger locking device to force the ball to disengage from a first indent and reengage to a second indent.

13. A method for locking and unlocking a paint applicator, comprising:

receiving, at a fluid inlet of a paint applicator, a source of paint;

actuating a trigger locking device, such that the trigger locking device, when actuated, moves from a locked position to an unlocked position, wherein, in the locked position, the source of paint is blocked from moving to a fluid outlet of the paint applicator, wherein the trigger locking device comprises a ball and spring configuration such that the spring is configured to provide a biasing force against the ball, such that the ball engages an indent of the trigger locking device, and wherein actuating the trigger locking device comprises application of sufficient pressure to an edge of the trigger locking device to force the ball to disengage from a first indent and reengage to a second indent of the trigger locking device; and actuating a trigger of the paint applicator such that the source of paint moves from the fluid inlet to the fluid outlet.

14. The method of claim 13, wherein, in the locked position, the trigger is substantially immovable.

15. The method of claim 13, and further comprising:

removing a fixing mechanism configured to hold the trigger locking device in a fixed position.

* * * * *